United States Patent [19]

Moran

[11] Patent Number: 5,010,669

[45] Date of Patent: Apr. 30, 1991

[54] POST CARD WITH POP-OUT FIGURE

[76] Inventor: George Moran, 800 Electric Ave., Seal Beach, Calif. 90740

[21] Appl. No.: 354,101

[22] Filed: May 22, 1989

[51] Int. Cl.[5] ..... G09F 1/08

[52] U.S. Cl. ..... 40/539; 40/124.1; 229/92.8

[58] Field of Search ..... 40/124.1, 539, 538, 40/152.1; 229/92.8; 428/9, 11, 8, 7

[56] References Cited

U.S. PATENT DOCUMENTS

| | | | |
|---|---|---|---|
| 163,520 | 5/1875 | Petersohn | 229/92.8 |
| 1,705,116 | 3/1929 | Howland | 40/124.1 |
| 2,219,492 | 10/1940 | Prichap | 229/92.8 |
| 2,282,280 | 5/1942 | Yogg | 40/124.1 |
| 2,472,166 | 6/1949 | Mathewson | 229/92.8 |
| 4,024,661 | 5/1977 | Kitamura et al. | 40/124.1 |
| 4,055,690 | 10/1977 | Patterson | 229/92.8 |

FOREIGN PATENT DOCUMENTS

| | | | |
|---|---|---|---|
| 371448 | 3/1907 | France | 229/92.8 |
| 572687 | 6/1924 | France | 40/538 |
| 460715 | 12/1950 | Italy | 40/124.1 |
| 20056 | 9/1899 | Switzerland | 229/92.8 |
| 20629 | 11/1899 | United Kingdom | 229/92.8 |
| 498716 | 1/1939 | United Kingdom | 229/92.8 |

*Primary Examiner*—Kenneth J. Dorner
*Assistant Examiner*—J. Hakomaki
*Attorney, Agent, or Firm*—Charles H. Thomas

[57] ABSTRACT

A mailing card is formed of card stock conforming to the dimensional and weight requirements applicable to postal service post cards. A figure is printed on the face of the card stock and a perforated outline on the card stock circumscribes a portion of the figure. An indicia of placement of a postage stamp appears on the opposite surface of the card stock. Preferably, at least one discontinuous straight line of weakness is defined in the card stock. The line of weakness intersects the perforated outline. A gap is defined within the discontinuous line of thickness within the figure. The card stock is foldable along the line of weakness such that the portion of the figure within the perforated outline does not fold, and the remaining portion of the card does fold back to form a stand for supporting the figure in an upright disposition.

16 Claims, 2 Drawing Sheets

POST CARD WITH POP-OUT FIGURE

BACKGROUND OF THE INVENTION

1. Field of the Invention

The present invention is directed to a pop-out figure defined on a sheet of card stock that is suitable for transmission through the mails.

2. Description of the Prior Art

For many years artistic and photographic figures have been printed on card stock for various purposes and have been delineated by perforated outlines such that the figures are either totally or partially separable from the card stock upon which they are printed. For example, doll figures printed on card stock and circumscribed by perforated outlines have long been enjoyed by children of various ages. In some instances the perforated outlines define a base which can be folded under the printed figure to thereby form a stand or support which allows the figure to project upwardly from a flat, horizontal surface.

Also, various advertising and promotional novelties have been constructed of figures wholly or partially outlined on card stock such that at least a portion of the figure can be separated from the adjacent marginal areas of the original card stock sheet by exerting forces in opposite directions between the figure and the adjacent marginal areas of the card stock to shear the webbing between the perforations on the perforated outline. The figure will thereupon totally or partially separate from the card stock on which it is originally formed.

SUMMARY OF THE INVENTION

While stand-up or pop-up card stock figures have long been employed for different amusement or promotional purposes, such figures have heretofore not been provided in a card stock form suitable for transmission through governmental postal services.

It is an object of the present invention to provide a mailing card comprising a rectangular sheet of card stock which meets the requirements for mailing through governmental postal services, and from which a printed figure can be partially structurally separated from the marginal surrounding areas of the original rectangular card stock such that these marginal areas can be folded back into a configuration forming a base for supporting the figure in an upright disposition on a horizontal surface. The unique mailing card of the invention provides the user with a novelty item which can be sent to friends and relatives through governmental postal services as a greeting, as an indicia of some particular event, such as a sporting event, or in the form of a picture taken at a location, such as a vacation destination.

When the article of the invention is procured by a user, it is initially a flat, planar sheet of card stock having a figure printed on one surface. The figure is partially circumscribed by a perforated outline which delineates the top and opposite lateral sides of the figure depicted. The perforated outline terminates at laterally separated ends near the bottom of the figure.

Preferably, at least one straight line of weakness, such as a line of reduced thickness of the card stock, is defined on the card stock to extend outwardly from both sides of the circumscribed figure through the marginal areas of the card stock to the lateral edges of the card stock sheet. The line of weakness is discontinuous and does not extend through the circumscribed figure, so that while the marginal areas of the sheet of card stock on both sides of the figure readily bend at the lines of weakness, the figure itself remains flat and substantially planer. The marginal areas of the card stock sheet are folded away from the figure in such a manner as to form a base that supports the planar figure in a generally upright disposition.

Conventional postcards have a significant disadvantage of being only two dimensional and therefore lack any particular characteristic which might forcefully call attention to a particular portion of the card. Since conventional postcards lack any feature of uniqueness once they have been conveyed their greeting, they retain little impact and are often soon discarded.

One object of the present invention is to provide a postcard which may be converted from a flat, rectangular two dimensional structure to a semi-permanent display device. The postcard of the invention is intriguing and forcefully captures the viewer's attention. The card of the invention makes a lasting impression and therefore has enhanced marketing, sales and promotional potential.

The mailing card of the invention may be imprinted with sporting figures, sporting emblems, famous buildings, public figures, landmarks and other figures of interest. These printed figures can be transmitted flat on the card stock upon which they are formed without envelopes and as mailing cards through governmental postal services. When the mailing cards reach their destinations and intended addressees, the figures can be popped out and away from the surrounding card stock to form upright mementos which can be saved and displayed on a desk or shelf. The figures depicted may be well-known persons, such as baseball players, movie stars, as well as fictitious entities, such as cartoon characters and fictitious beings. The figures may also depict inanimate articles, such as landmark buildings, trees, sculptures and other artistic figures or articles of interest.

The mailing card of the invention also finds considerable utility as an eye catching advertising medium. In such applications a logo, trademark or other symbol associated with goods or services to be promoted can be printed on a mailing card and partially circumscribed by a perforated pattern. Such as a figure can be popped out from the remaining structure in a prominent manner to draw the attention of an observer. Thus, images of spokespersons associated with prepared food outlets, breakfast cereals, television shows, and automobiles, for example, may be depicted as the figures of interest on the mailing card of the invention.

Cards according to the invention may also be utilized as greeting cards and novelty postcards to communicate with friends and loved ones while on vacation or in connection with attendance at significant events, such as championship sporting events or olympic contests.

In one broad aspect the present invention is a mailing card comprising a rectangular sheet of card stock having a face and an opposite obverse surface, a pair of straight mutually parallel longitudinal edges, and a pair of straight mutually parallel transverse edges perpendicular to the longitudinal edges. A figure is printed on the face of the card stock. A perforated outline on the card stock circumscribes a portion of the figure and terminates at both ends proximate to a selected one of the edges of the card stock. An indicia of placement of the postage stamp is defined near one corner of the card stock on the obverse surface. Preferably, at least one discontinuous straight line of weakness is defined on the card stock and extends to the perforated outline from the edges thereof that are perpendicular to the selected edge. A gap is thereby defined in the line of weakness and extends across the figure.

Preferably, the ends of the perforated outline terminate equidistant from the selected one of the edges and a plurality of mutually parallel lines of weakness are defined across the sheet of card stock. By terminating the perforated outline equidistant from the selected one of the edges, the figure area will stand out from the marginal areas of the card stock to the same extent on both sides of the figure. By providing a plurality of mutually parallel, discontinuous lines of weakness across the marginal areas of the card stock, the perforated outline of the figure can be folded several times to provide a more stable stand supporting the upright figure.

Where multiple lines of weakness are formed across the card stock it is preferable for at least one of the selected one of the edges of the card stock and the edge of the card stock parallel to that selected edge to be slotted. In this way the selected edge and the edge parallel thereto overlap and interlock to form a flat base capable of resting upon a horizontal surface so as to support the pop-out figure in an upright disposition.

It is extremely important for the mailing card of the invention to be acceptable for transmission by governmental postal services, preferably at the postcard rate. To be acceptable for transmission as a postcard by the United States Postal Service, the mailing card of the invention may not be smaller than three and one half by five inches nor larger than four and one quarter inches by six inches. Also, to be mailed as a postcard the mailing card of the invention must be rectangular in shape and have a uniform thickness not less than 0.007 inches and not greater than 0.0095 inches.

In order for the printed figure to be of a suitable size and shape desired by the user, some mailing cards of the invention may not meet the standards for mailing as a postcard. Nevertheless, such mailing cards can still be mailed as standard pieces of first class mail if the width of the mailing card is no greater than six and one eighth inches, the length of the mailing card is no greater than eleven and one half inches, and the ratio of length to width is such that the mailing piece fits within a template provided by the United States Postal Service as Notice 3A, dated May, 1981. Also, to qualify for standard first class mail the piece must may one ounce or less, must be at least 0.007 inches thick and no more than 0.25 inches thick. Mailing cards which do not meet these requirements may still be mailed, but are subject to a surcharge that is added to non-standard mail.

In the invention the printed figure that is partially circumscribed by the perforated outline occupies only a portion of the surface area of the mailing card such that there are sufficient marginal areas remaining above and beneath the figure to form a stable base or stand. Preferably, there are at least three mutually parallel discontinuous lines of weakness formed on the mailing card so that the ends of the mailing card above and beneath the figure can be folded over in an overlapping relationship. This provides the figure with a horizontal base of a double card stock thickness. Preferably, at least one of the edges of the card stock above or beneath the figure is slotted, so that the edges that are parallel to the lines of weakness are interlockable. That is, one edge of the card will fit into the slots defined in the opposite edge. Preferably, also both edges are slotted to increase the extent of engagement of the interlocking edges. The extreme marginal areas above and beneath the figure are thereby interlocked in overlapping fashion to form a flat base for supporting the figure in an upright disposition.

Instructions for the separation of the portion of the figure circumscribed by the perforated outline from the surrounding marginal areas within the rectangular boundaries of the card, and the instructions for folding those areas and interlocking the edges of the card above and beneath the figure are printed on the obverse side of the card stock, opposite the side upon which the figure is printed. Thus, a recipient of the mailing card of the invention who is unfamiliar with its use may be clearly directed in the manner of use of the card for its intended purpose, once it has been delivered by the postal service.

In order for the outlined portion of the printed figure on the mailing card to stand out away from the adjacent marginal areas of the card stock, the perforated outline must extend around three sides of the figure, thereby defining a peninsular figure area within the perforated pattern. The perforated pattern does not extend completely around the figure, since the figure must stay attached at its bottom to the remaining area of tne card stock.

The indicia of placement of a postage stamp on the surface of the card stock opposite the surface on which the figure is printed is preferably located proximate to the bottom of the figure near that portion of the figure which is not circumscribed by the perforated outline. The reason for this arrangement is that postcards and other mailing cards are fed through stamp cancelling machinery by inserting first the edge of the card adjacent to the postage stamp. The card then travels through the machinery with the unperforated base of the figure preceding the perforated top of the figure. When the indicia placement of a postage stamp is positioned on the obverse side of the card stock proximate to the base of the printed figure in this manner, there is less likelihood that postal service processing will cause undesired and premature separation of the outlined figure area from the adjacent marginal areas of the card.

The invention may be described with greater clarity and particularity by reference to the accompanying drawings.

DESCRIPTION OF THE EMBODIMENTS

Figure 1:
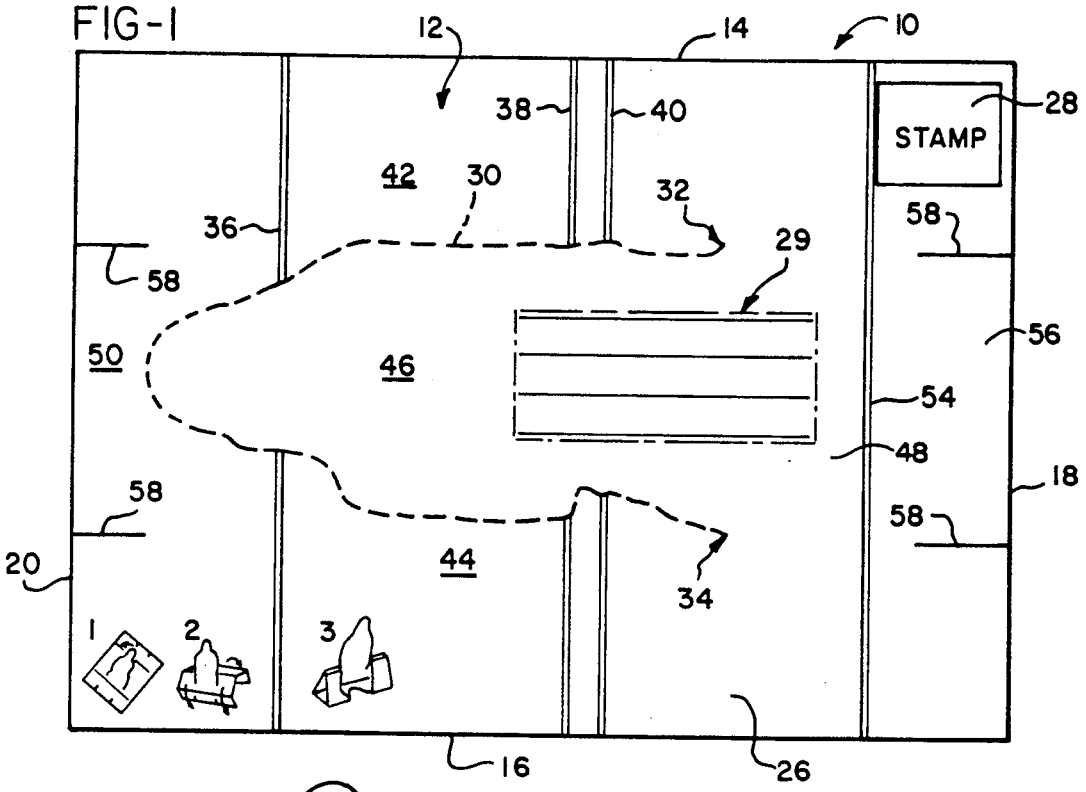
FIG. 1 is a plan view of the obverse side of one preferred embodiment of the invention prior to mailing and assembly.

FIG. 1 illustrates a mailing card 10 formed of a flat, rectangular sheet of card stock 12. The card stock sheet 12 is bounded by a pair of long lateral edges 14 and 16 and a pair of short transverse edges 18 and 20. The mailing card 10 has a FIG. 22 printed on its front surface 24. The printed FIG. 22 is visible in FIG. 2, which shows the mailing card 10 assembled. On the opposite surface 26, visible in FIG. 1, there is an indicia 28 of a postage stamp position printed proximate to the corner of the card stock 12 formed by the intersection of a selected one of the long edges, such as the long edge 14 and a selected one of the short edges, such as the short edge 18. Several parallel straight lines are printed on the obverse surface 26 below and to the left of the stamp indicia 28. These lines are indicated collectively at 29 in FIG. 1. The name and address of the addressee are written on lines 29, and a message is written in the space to the left thereof prior to the mailing.

The card stock 12 is constructed with a circumscribing perforated outline or pattern 30 that extends about the upper body portion of the FIG. 22. The ends 32 and 34 of the outline terminate in spaced separation from each other proximate to the selected short edge 18. In a mailing card according to the invention there is preferably at least one discontinuous straight line of weakness on the card stock 12 extending parallel to the short transverse edges 18 and 20. In the embodiment of FIGS. 1-5 there are, in fact, three separate parallel discontinuous straight lines of weakness indicated at 36, 38 and 40. The lines of weakness 36, 38 and 40 are lines of reduced thickness of the card stock 12 between the surfaces 24 and 26. The discontinuous straight lines of weakness 36, 38 and 40 each have a pair of linearly aligned straight line segments that extend from the lateral edges 14 and 16 to the perforated outline pattern 30 therebetween.

One of the line segments within each pair of segments in each of the discontinuous lines of weakness 36, 38 and 40 extends from the longitudinal edge 14 to the perforated pattern 30 through the marginal area 42 therebetween. Similarly, the other line segment within each pair of line segments in each of the discontinuous straight lines of weakness 36, 38 and 40 extends from the opposite longitudinal edge 16 to the perforated outline pattern 30 through the marginal area 44 therebetween. All of the line segments in the discontinuous lines of weakness 36, 38 and 40 terminate at the perforated pattern 30 and at the figure area. The front of the figure area is printed with the FIG. 22, which is visible in FIG. 2, and the opposite rear face of the figure area is indicated at 46 in FIG. 1.

As is evident from FIG. 1, the perforated pattern or outline 30 extends about the top and sides of the FIG. 22 and terminates at the pattern ends 32 and 34 which are located proximate to and equidistant from the selected short edge 18. The perforated pattern thereby forms a demarcation about three sides of the FIG. 22 of a generally peninsular shape. The marginal areas 42 and 44 extend from the sides of the peninsular figure area 46 to the parallel lateral or latitudinal edges 14 and 16 respectively. The marginal areas 48 and 50 on the card stock 12 extend from the peninsular figure area 46 to the short or transverse edges 18 and 20, respectively.

Figure 2:
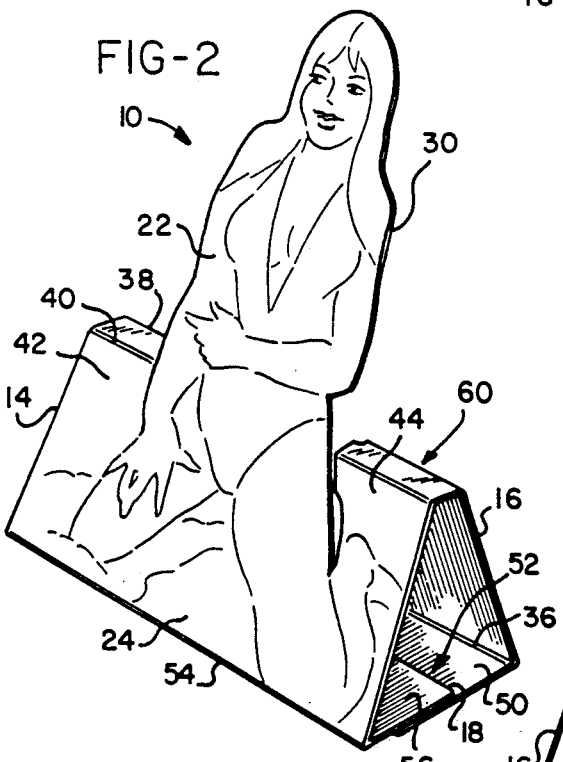
FIG. 2 is a front perspective view of the card of FIG. 1 after folding subsequent to receipt through a postal service.
Figure 3:
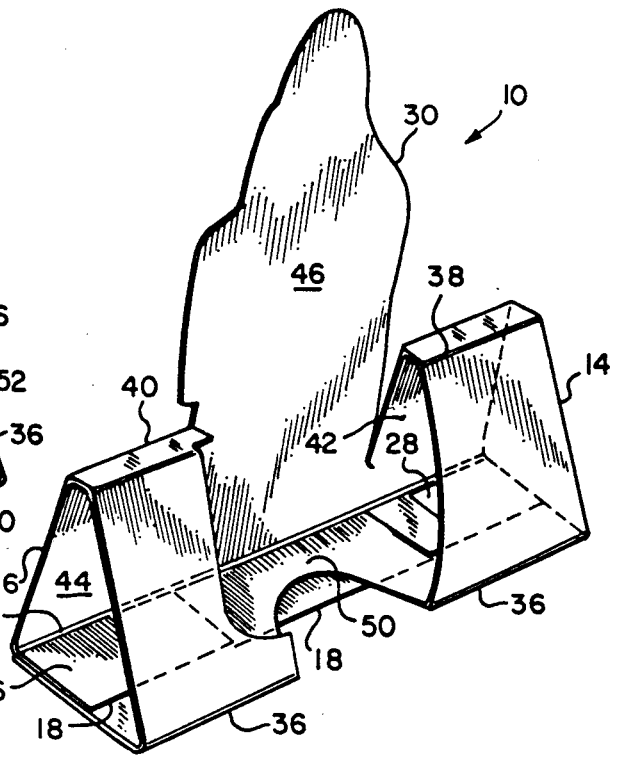
FIG. 3 is a rear perspective view of the assembled card of FIG. 2.

The marginal areas 42, 44 and 50 between the figure area 46 and the longitudinal edges 14 and 16 and the second transverse edge 20 are foldable away from the figure area 46 along the discontinuous lines of weakness 36, 38 and 40. The folds are such that when the mailing card is folded the marginal areas 48 and 50 proximate to the transverse edges 18 and 20 form a stand 60 with a flat base 52. The stand 60 holds the peninsular figure area 46, having the printed FIG. 22 on its front side, in an upright disposition as illustrated in FIGS. 2 and 3.

The figure area 46 forms a gap in the discontinuous lines of weakness 36, 38, and 40 within the printed FIG. 22 so that the marginal areas of the card stock 12 are foldable along the lines of weakness 36, 38, and 40 in a direction back away from the front face 24. By exerting a forward force on the figure area 46 by means of pressure against the back side 26 of the card stock 12, and by exerting rearward forces on the marginal areas 42, 44, and 50, by means of pressure on the front side 24 of the card stock 12, the webbing of the perforated outline 30 will shear so that the upper portion of the FIG. 22 will separate on three sides from the remainder of the card stock 12.

Figure 4:
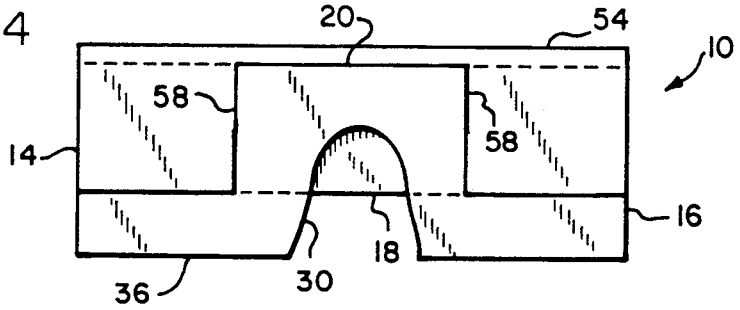
FIG. 4 is a bottom plan view of the assembled card of FIGS. 2 and 3.

As illustrated in FIG. 1, the ends 32 and 34 of the perforated pattern or outline 30 terminate equidistant from the selected short side 18 of the card stock sheet 12. The mailing card 10 is also comprised of a continuous straight line of weakness 54 on the card stock sheet 12 that extends entirely across the card stock sheet 12, so that the portion 56 of the marginal area 48 closest to the short edge 18 can be folded over against the marginal area 50 at the opposite end of the card stock 12 in overlapping fashion, as illustrated in FIGS. 2, 3, and 4.

Both of the transverse edges 18 and 20 are slotted by means of slits 58 that extend perpendicular to the transverse edges 18 and 20 and into the structure of the card stock 12 in the marginal areas 48 and 50. Each of the transverse edges 18 and 20 is thereby able to receive other transverse edge in interleaved fashion, as best illustrated in FIGS. 3 and 4, so that the portion 56 of the marginal area 48 and the marginal area 50 of the card stock 12 adjacent to the transverse edges 18 and 20 are engageable together in overlapping relationship to form a flat base. The card stock 12 is foldable along all of the lines of weakness 36, 38, 40, and 54 such that the FIG. 22 projects upwardly from the base 52. The base 52 is formed of a double thickness of the card stock where the portion 56 of the marginal area 48 is interengaged with the marginal area 50. The portion of the card stock 12 other than the figure area 46 then forms a stand 60 which supports the FIG. 22 in an upright disposition, as illustrated in FIGS. 2 and 3.

When the marginal areas 48 and 50 reside in overlapping arrangement as depicted in FIGS. 2 and 3, the card stock 12 provides the FIG. 22 with an upright, generally triangular shaped stand that supports the FIG. 22 upright, slightly inclined to the rear. The mailing card 10, when deployed as depicted in FIGS. 2 and 3, can be rested on any horizontal surface, such as a shelf, desk or table top. The FIG. 22 is thereby prominently featured and is supported by the stand 60.

Since the recipient of the mailing card 10 may be unfamiliar with its use and manner of deployment, it is advisable to provide printed instructions on the card stock 12 for the separation of the upper portion of the FIG. 22 and the creation of the stand 60. These instructions may take the form of pictorial illustrations of the steps of assembly depicted on the obverse side 26 of the card stock 12 at 1, 2, and 3 in FIG. 1. Alternatively, the instructions may take the form of verbal, printed instructions, also on the obverse side 26 of the card stock 12.

Figure 5:
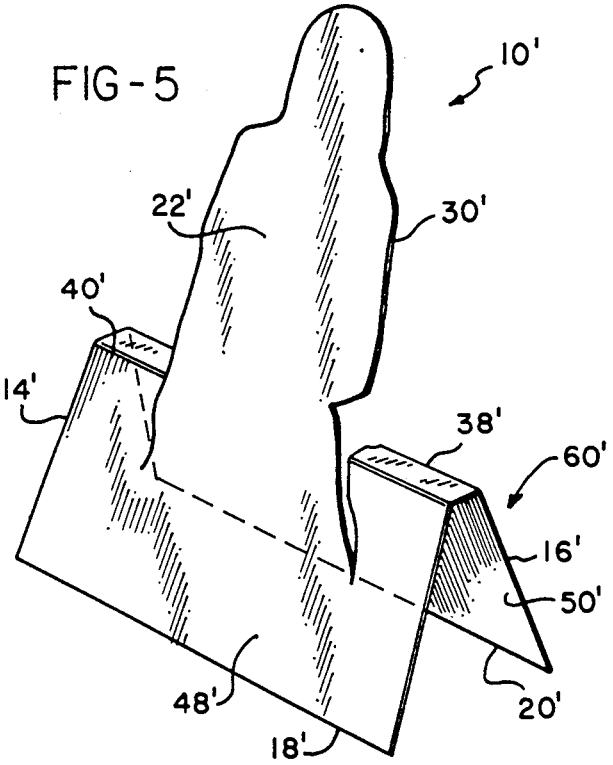
FIG. 5 is a front perspective view of an alternative embodiment of the mailing card of the invention.

FIG. 5 illustrates an alternative embodiment 10' of the mailing card of the invention. The mailing card 10' differs from the mailing card 10 in that it has a stand 60' which requires only two discontinuous lines of weakness 38' and 40' and no continuous lines of weakness extending between the lateral edges 14' and 16'. The stand 60' does not include a flat base, but rather is formed by the planar inclined marginal areas 48' and 50'. The transverse edges 18' and 20' rest on a horizontal support to hold the FIG. 22' in an upright disposition, separated from the remainder of the card stock along the perforated pattern outline 30'. While the mailing card 10' is of a simpler construction than the mailing card 10, the stand 60' provides a less stable support than the stand 60.

Figure 6:
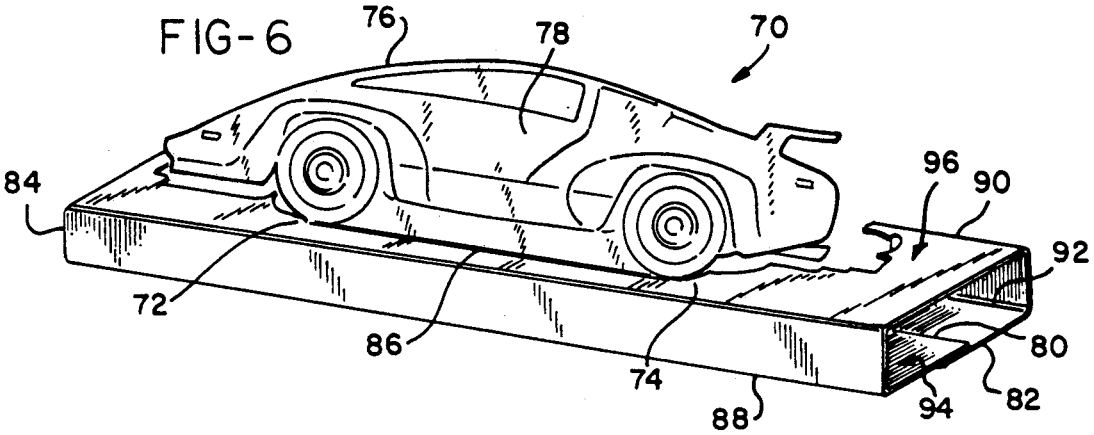
FIG. 6 is a front perspective view of another alternative embodiment of the mailing card of the invention.

FIG. 6 illustrates another alternative embodiment of a mailing card 70 according to the invention. The mailing card 70 differs from the mailing card 10 in that the ends 72 and 74 of the perforated outline 76 of the printed FIG. 78 are proximate to one of the longer edges 80 of the card stock 82, rather that to either one of the shorter edges 82 or 84 thereof. In the mailing card 70 there is a continuous lines of weakness 88 defined on the card stock below the bottom of the FIG. 78.

A discontinuous line of weakness 86 is parallel to the long transverse edge 80 and passes across the bottom of the FIG. 78 and through the ends 72 and 74 of the perforated outline 76 of the FIG. 78 rather than across the marginal areas on either side of the FIG. 78. The FIG. 78 is thereby foldable in one direction about the continuous straight line 82. Like the mailing card 10, the mailing card 70 is comprised of a plurality of mutually parallel lines of weakness 90 and 92 having linear aligned segments extending through the marginal areas on both sides of the FIG. 78. Also, the longer, transverse edges 80 of the card stock of which the mailing card 70 is formed are slotted like those of the mailing card 10 to form a flat base 94 and a rectangular stand 96 which supports the FIG. 78 in an upright disposition.

All of the mailing cards 10, 10', and 70 are of a size and weight acceptable for mailing through governmental postal services. The longest edges, namely the lateral edges 14 and 16 of the mailing card 10, the lateral edges 14' and 16' of the mailing card 10', and the transverse edges 80 of the mailing card 70 are between five and eleven and one-half inches in length. The shortest of the edges, namely the transverse edges 18 and 20 of the mailing card 10, the transverse edges 18' and 20' of the mailing card 10' and the lateral edges 82 and 84 of the mailing card 70 are between three and one-half and six and one-half inches in length. In the mailing cards 10 and 10' the shortest edges are the transverse edges 18 and 20 and 18' and 20', respectively, and the longest edges are the lateral or longitudinal edges 14 and 16 and 14' and 16', respectively. In the mailing card 70, on the other hand, the shortest edges are the lateral edges 82 and 84, while the longest edges are the transverse edges 80.

Preferable the mailing cards 10, 10,' and 70 are configured of sizes acceptable for mailing as postcards. The shortest of the edges are between three and one-half and five inches in length. The longest of the edges, are between four and one-quarter and six inches in length. The card stock of which the mailing cards are constructed is between 0.007 and 0.0095 inches in thickness.

Mailing card of the invention may be provided with a multitude of different figures suitable for many different purposes. For example, the mailing cards may be printed with figures of buildings, towers, cathedrals, and spires which are associated with particular geographical locations so that the mailing cards can be sent as postcards. A message can be written on the obverse side of the postcard and delivered by the postal service. After the message is read, the post card is not discarded, or kept concealed in a drawer, but rather the portion of the figure delineated by the perforated outline is pressed away from the card stock and the remaining portion of the card stock is formed into a stand to support the figure in an upright disposition. Similarly, figures of sports heros, movie stars and famous personalities can likewise be sent through the mails by means of the mailing card form of the invention, and then displayed in the manner depicted in the drawings once the cards have been delivered by the postal service.

Undoubtedly numerous variations and modifications of the invention will become readily apparent to those familiar with mailing cards. Accordingly the scope of the invention should not be construed as limited to the specific embodiments depicted and described, bur rather is defined in the claims appended hereto.

I claim:

1. A mailing card comprising a single rectangular planar, sheet of only a single thickness of card stock having a face and an opposite obverse surface, a pair of straight mutually parallel longitudinal edges and a pair of straight mutually parallel transverse edges perpendicular to said longitudinal edges, a figure printed on said face of said card stock, a perforated outline formed as a frangible tear line on said card stock extending entirely through the thickness of said card stock and circumscribing a portion of said figure and terminating at both ends proximate to a selected one of said edges such that said portion of said figure is separable along said frangible tear line from the surrounding areas of said card stock adjacent said perforated outline to leave an opening therebehind in the shape of said portion of said figure extending entirely through the thickness of said card stock, a plurality of mutually parallel lines of weakness defined on said card stock extending parallel to said selected one of said edges, wherein at least one of said lines of weakness is discontinuous and is defined on said card stock and extends to said perforated outline from said edges of said card that are perpendicular to said selected one of said edges, thereby defining a gap in said line of weakness that extends across said figure and an indicia of placement of a postage stamp near one corner of said card stock on said obverse surface.

2. A mailing card according to claim 1 further characterized in that said ends of said perforated outline terminate equidistant from said selected one of said edges.

3. A mailing card according to claim 2 further comprising a plurality of mutually parallel discontinuous lines of weakness as aforesaid.

4. A mailing card according to claim 3 further characterized in that at least one of said selected one of said edges of said card stock and the edge thereof parallel to said selected edge is slotted, whereby said selected edge and said edge parallel thereto are interlockable in overlapping fashion to form a flat base for supporting said figure in an upright disposition.

5. A mailing card according to claim 2 further comprising at least one continuous straight line of weakness on said sheet of card stock extending entirely across said sheet of card stock.

6. A mailing card according to claim 1 further characterized in that the longest of said edges are between five and eleven and one half inches in length, and the shortest of said edges are between three and one half and six and one half inches in length.

7. A mailing card according to claim 1 in which said card stock is formed as a postcard.

8. A mailing card comprising a planar sheet of only a single ply of card stock of rectangular shape having first and second opposite surfaces, opposite mutually parallel lateral edges and opposite mutually parallel first and second transverse edges extending perpendicular to and intersecting said lateral edges, whereby said edges define boundaries of said surfaces, an indicia of placement of a postage stamp on said first surface proximate to the intersection of said first transverse edge with one of said lateral edges, a figure having an outline printed on said second surface, a perforated pattern in the form of a frangible tear line extending along said outline, entirely through said single ply of card stock and within said boundaries proximate to only said longitudinal edges and said second transverse edge, thereby defining marginal areas between said perforated pattern and said edges and also defining a peninsular figure area within said perforated pattern, and a plurality of mutually parallel lines of weakness defined on said card stock parallel to said transverse edges, at least one of said lines of weakness being formed of at least one pair of linearly aligned straight line segments of reduced thickness of said card stock between said first and second surfaces extending from said lateral edges to said frangible tear line through said marginal areas therebetween and both terminating at said frangible tear line and at said peninsular figure area, whereby said marginal areas between said figure area and said lateral edges and between said figure area and said second transverse edge are foldable away from said figure area along said straight line segments such that said marginal areas proximate said transverse edges form a stand to hold said peninsular figure area in an upright disposition, and said peninsular figure area is separable from said marginal areas along said frangible tear line to leave an opening in the shape of said peninsular figure area between said marginal areas entirely through said single ply of card stock.

9. A mailing card according to claim 8 further comprising a plurality of said pairs of linearly aligned straight line segments as aforesaid.

10. A mailing card according to claim 9 wherein at least one of said transverse edges is slotted to receive the other of said transverse edges, whereby said marginal areas of said card stock adjacent said transverse edges are engageable together in overlapping relationship to form a flat base, and said card stock is foldable along said lines of reduced thickness such that said figure projects upwardly from said base.

11. A mailing card according to claim 8 wherein the shortest of said edges are between three and one half and five inches in length and the longest of said edges are between four and one quarter and six inches in length, and said card stock is between 0.007 and 0.0095 inches in thickness.

12. A mailing card according to claim 11 in which said shortest edges are said transverse edges and said longest edges are said lateral edges.

13. A mailing card according to claim 11 in which said shortest edges are said lateral edges and said longest edges are said transverse edges.

14. A mailing card formed of a single flat rectangular sheet of a single thickness of planar card stock bounded by a pair of long edges and a pair of short edges and having a figure printed on one surface and an indicia of a postage stamp position printed on the opposite surface proximate a corner formed by the intersection of a selected one of said long edges and a selected one of said short edges, a perforated outline in the form of a frangible tear line about a portion of said figure extending entirely through said thickness of card stock, the ends of said frangible tear line terminating in spaced separation from each other proximate to said selected short edge, and a plurality of straight lines of weakness defined on said card stock parallel to said short edges thereof, at least one of said lines of weakness being a discontinuous straight line of weakness on said card stock extending parallel to said short edges from said long edges and terminating at said frangible tear line on opposite sides of said figure, thereby leaving a gap in said discontinuous line of weakness within said figure, whereby said card stock is foldable so that said portion of said figure will separate along said frangible tear line from the remainder of said card stock to leave an opening having the shape of said portion of said figure entirely through said thickness of said card stock and said remainder of said card stock forms a stand which supports said figure in an upright disposition.

15. A mailing card according to claim 14 in which ends of said outline terminate equidistant from said selected short side of said sheet of card stock.

16. A mailing card according to claim 15 further comprising a plurality of said discontinuous straight lines of weakness as aforesaid whereby said card stock is foldable therealong such that said stand has a triangular cross section.

* * * * *